US006386058B1

(12) United States Patent
Lu

(10) Patent No.: US 6,386,058 B1
(45) Date of Patent: May 14, 2002

(54) FORWARD/BACKWARD STEERING CONTROL MECHANISM FOR A REMOTE-CONTROLLED TOY CAR

(76) Inventor: Ke-Way Lu, 3F, No. 322, Sec. 6, Min-Chau E. Rd., Taipei City (Green Lake Mansion ) (CN)

( * ) Notice: Subject to any disclaimer, the term of this patent is extended or adjusted under 35 U.S.C. 154(b) by 31 days.

(21) Appl. No.: 09/660,280

(22) Filed: Sep. 12, 2000

(51) Int. Cl.[7] ..... A63H 30/00
(52) U.S. Cl. ..... 74/332; 74/355; 446/443
(58) Field of Search ..... 74/332, 342, 355; 446/456, 457, 443

(56) References Cited

U.S. PATENT DOCUMENTS 1,262,901 A * 4/1918 Allen ..... 188/30
2,149,180 A * 2/1939 Muller ..... 446/442
2,625,831 A * 1/1953 Saunders, Jr. ..... 74/342
3,099,165 A * 7/1963 Heth et al. ..... 74/342
3,386,406 A * 6/1968 Tsunoda ..... 446/456
5,305,651 A * 4/1994 Perego ..... 192/48.91
5,762,532 A * 6/1998 Ishizuka et al. ..... 446/456

* cited by examiner

*Primary Examiner*—Charles A. Marmor
*Assistant Examiner*—Ankur Parekh
(74) *Attorney, Agent, or Firm*—Ladas & Parry

(57) ABSTRACT

A forward/backward steering control mechanism installed in a toy car and coupled to a power drive and controlled by a remote controller to move the toy car forwards/backwards. The forward/backward steering control mechanism uses a remote controller-controlled server to move a movable gear on the transmission shaft of the toy car relative to a transmission wheel, which is coupled to the power drive of the toy car, between a first position and a second position, so as to control the direction of rotation of the transmission shaft, and to further control forward/backward movement of the toy car.

1 Claim, 4 Drawing Sheets

FORWARD/BACKWARD STEERING CONTROL MECHANISM FOR A REMOTE-CONTROLLED TOY CAR

BACKGROUND OF THE INVENTION

The present invention relates to a forward/backward steering control mechanism for a remote-controlled toy car, and more particularly to such a forward/backward steering control mechanism, which is installed in a toy car and coupled to a power drive and controlled by a remote controller to move the toy car forwards/backwards.

Regular remote-controlled gasoline engine toy cars can be controlled to move forwards as well as backwards. The forward and backward movement of a remote-controlled gasoline engine toy car is achieved by means of the operation of an auxiliary transmission mechanism. According to conventional designs, the forward transmission mechanism and the backward transmission mechanism of a remote-controlled gasoline engine toy car are separately operated, i.e., the player must operate the remote controller to drive the forward transmission mechanism, causing the forward transmission mechanism to move the toy car forwards. On the contrary, when moving the toy car backwards, the player must operate the remote controller to drive the backward transmission mechanism. Because two transmission mechanisms are needed, conventional remote-controlled gasoline engine toy cars are commonly heavy and expensive, and consume much gasoline during operation. In order to eliminate these drawbacks, the present inventor invented a forward-reverse transmission control mechanism for motion toy car, which was filed under patent application Ser. No. 09/545,634. This structure of forward-reverse transmission control mechanism comprises a transmission tube coupled to the engine of the motion toy car, a transmission shaft inserted through the transmission tube and driven to rotate the front wheel system and rear wheel system forwards or backwards, a sliding switching gear, a first transmission gear fixedly mounted on the transmission tube, a second transmission gear fixedly mounted on the transmission shaft, two idle gears moved between a first position where both idle gears are meshed with the first transmission gear and the second transmission gear, enabling the transmission shaft to be rotated clockwise to move the motion toy car forwards, and a second position where both idle gears are disengaged from the second transmission gear, and the sliding switching gear is meshed with the second transmission gear, enabling the transmission shaft to be rotated counter-clockwise to move the motion toy car backwards. This design of forward-reverse transmission control mechanism is functional, however, this design of forward-reverse transmission control mechanism is still complicated, and the manufacturing cost of the motion toy car still cannot be reduced to the desired level.

SUMMARY OF THE INVENTION

The present invention provides a forward/backward steering control mechanism installed in a toy car controlled by a remote controller to move the toy car forwards/backwards. The forward/backward steering control mechanism comprises a transmission shaft coupled between the front wheel system and rear wheel system of the toy car, a transmission wheel revolvably mounted on the transmission shaft and coupled to the power drive of the toy car, a first idle gear meshed with the transmission wheel, a second idle gear meshed with the first idle gear, a movable gear mounted on a polygonal segment of the transmission shaft and moved between a first position where the movable gear is meshed with an internal gear of the transmission wheel for enabling the transmission shaft to be rotated with the transmission wheel clockwise to move the toy car forwards, and a second position where the movable gear is disengaged from the transmission wheel and meshed with the second idle gear to rotate the transmission shaft counter-clockwise in moving the toy car backwards during rotary motion of the transmission wheel; and a server controlled by the remote controller to move the movable gear between the first position and the second position.

DETAILED DESCRIPTION OF THE PREFERRED EMBODIMENT

Figure 1:
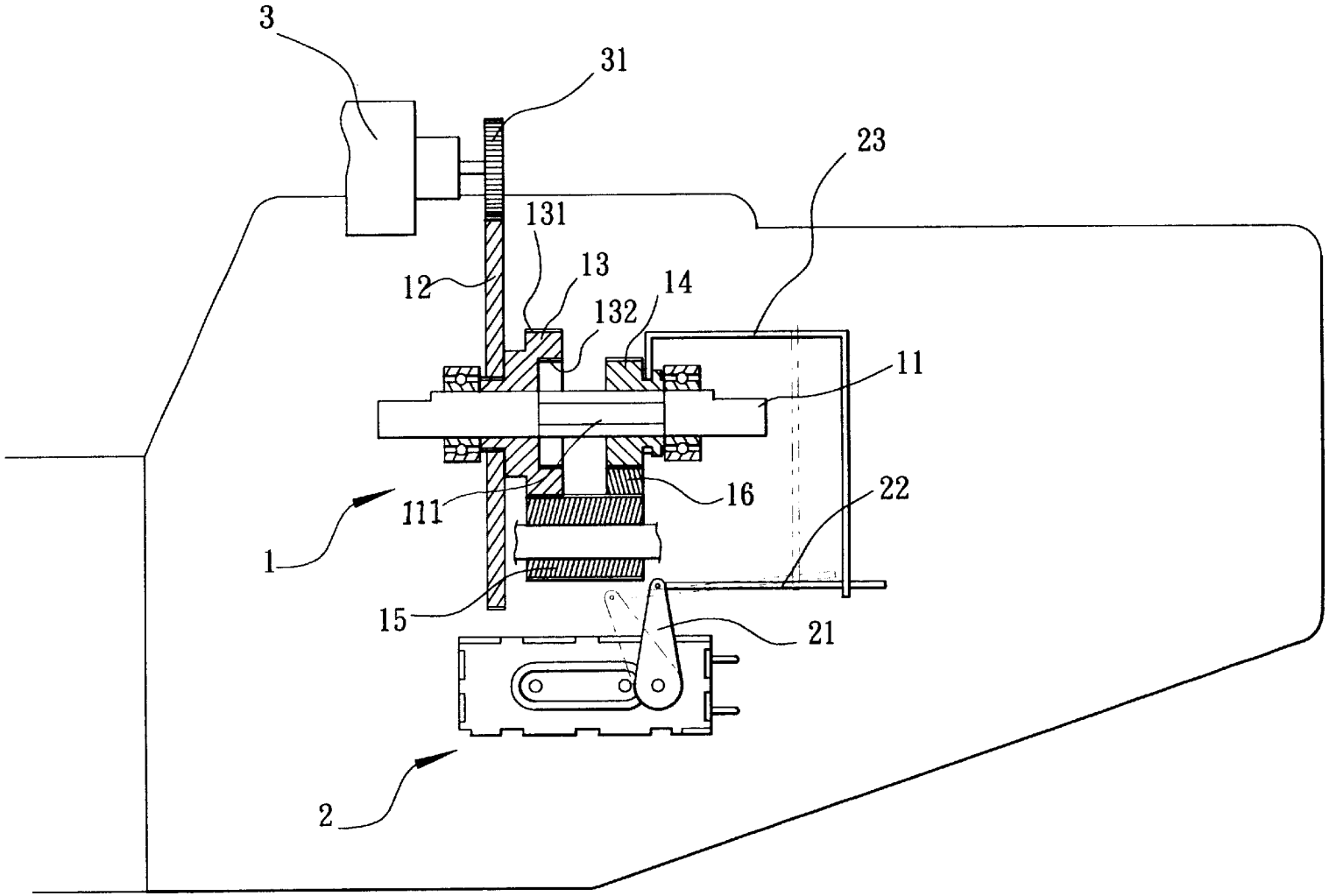
FIG. 1 is a plain view of a forward/backward steering control mechanism for a remote-controlled toy car according to the present invention.

Referring to FIG. 1, a forward/backward steering control mechanism for a remote-controlled toy car is shown comprising a transmission shaft 11. The transmission shaft 11 is coupled between the front wheel system and rear wheel system (not shown) of the toy car, and revolvably supported on bearings (not shown), having a polygonal segment 111. A transmission wheel 13 is mounted on the transmission shaft 11, and can be rotated relative to the transmission shaft 11. The transmission wheel 13 comprises an external gear 131 and an internal gear 132. A driven gear 12 is fixedly mounted on the transmission wheel 13 for synchronous rotation. A driving gear 31 is coupled to the engine 3 of the toy car, and meshed with the driven gear 12. A movable gear 14 is longitudinally slidably mounted on the polygonal segment 111 of the transmission shaft 11, and prohibited from rotary motion relative to the transmission shaft 11 (the movable gear 14 has a polygonal center hole fitting the polygonal cross-section of the polygonal segment 111, so that the movable gear 14 is prohibited from rotary motion relative to the transmission shaft 11). The movable gear 14 can be moved along the polygonal segment 111 of the transmission shaft 11 between a first position where the movable gear 14 is forced into engagement with the internal gear 132 of the transmission wheel 13 for enabling the transmission shaft 11 to be rotated with the transmission wheel 13, and a second position where the movable gear 14 is disengaged from the internal gear 132 of the transmission wheel 13, preventing a rotation of the transmission shaft 11 with the transmission wheel 13. A first idle gear 15 is provided and meshed with the external gear 131 of the transmission wheel 13. A second idle gear 16 is provided and meshed with the first idle gear 15. When moving from the first position to the second position, the movable gear 14 is forced into engagement with the second idle gear. The forward/backward steering control mechanism further comprises a server 2. The server 2 comprises a rocker arm 21. A first link 22 is coupled to the rocker arm 21. A second link 23 is coupled between the first link 22 and the movable gear 14.

Figure 2:
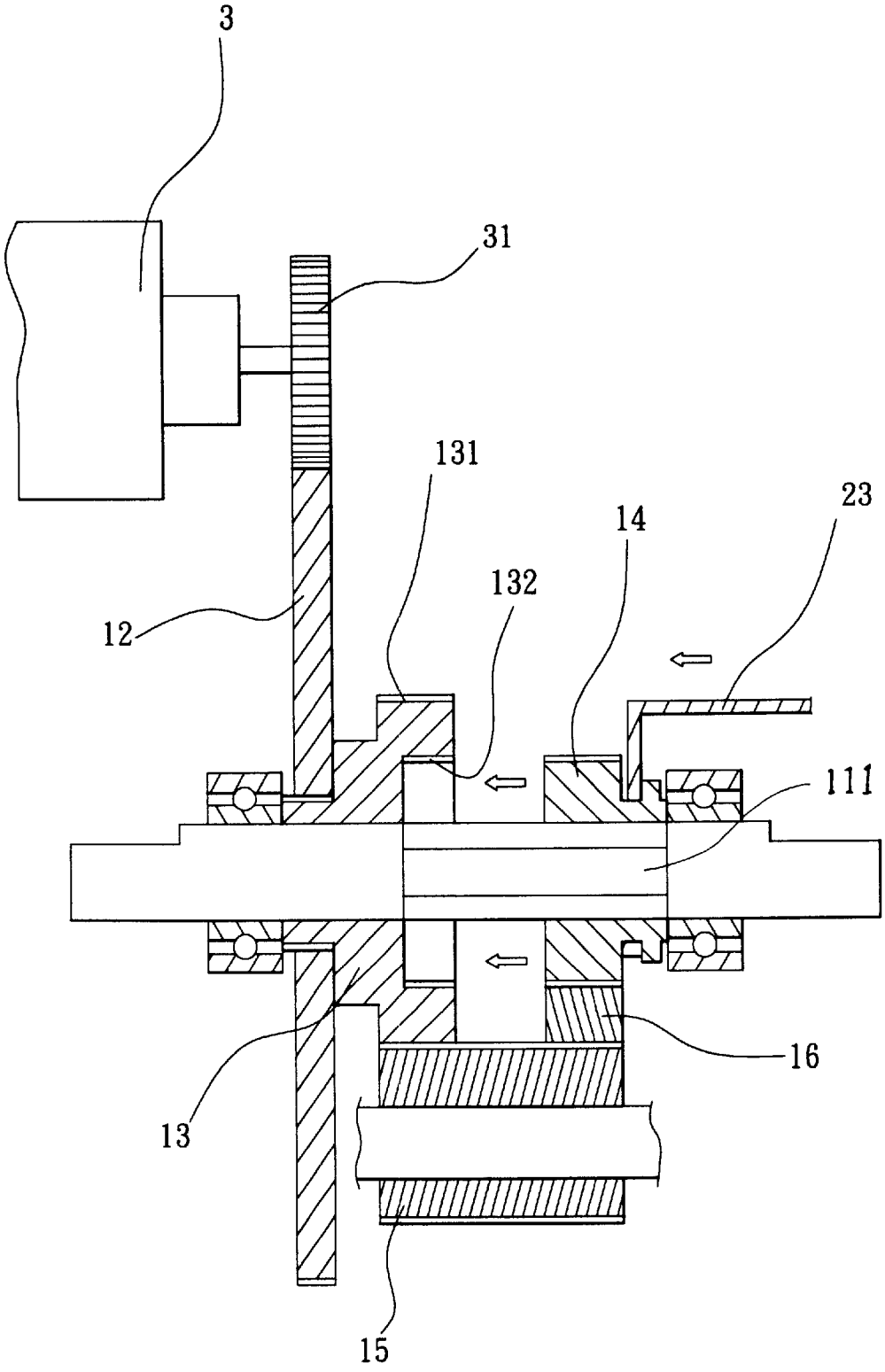
FIG. 2 is a sectional view showing the movable gear moved to the second position according to the present invention.
Figure 3:
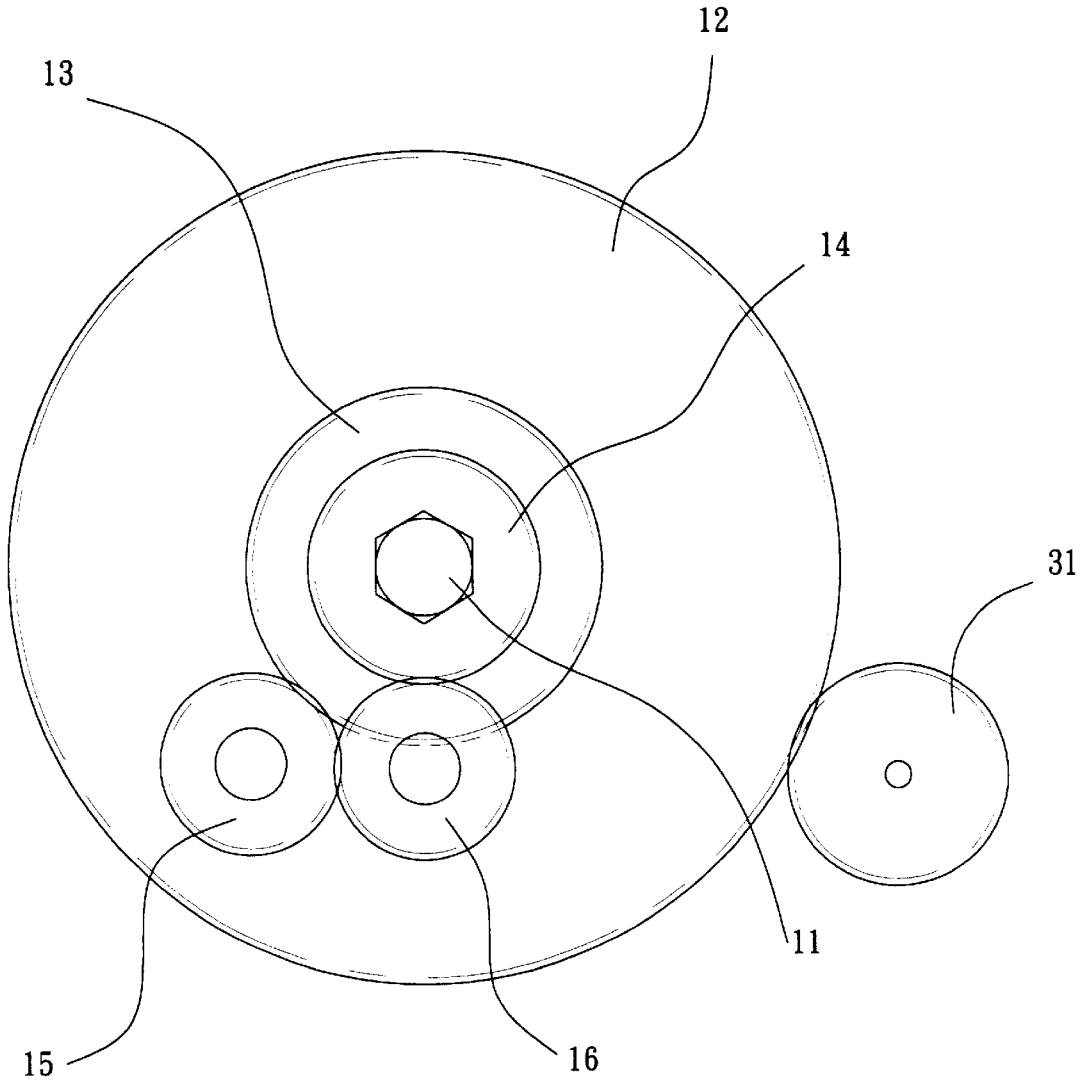
FIG. 3 is a side view of FIG. 2.
Figure 4:
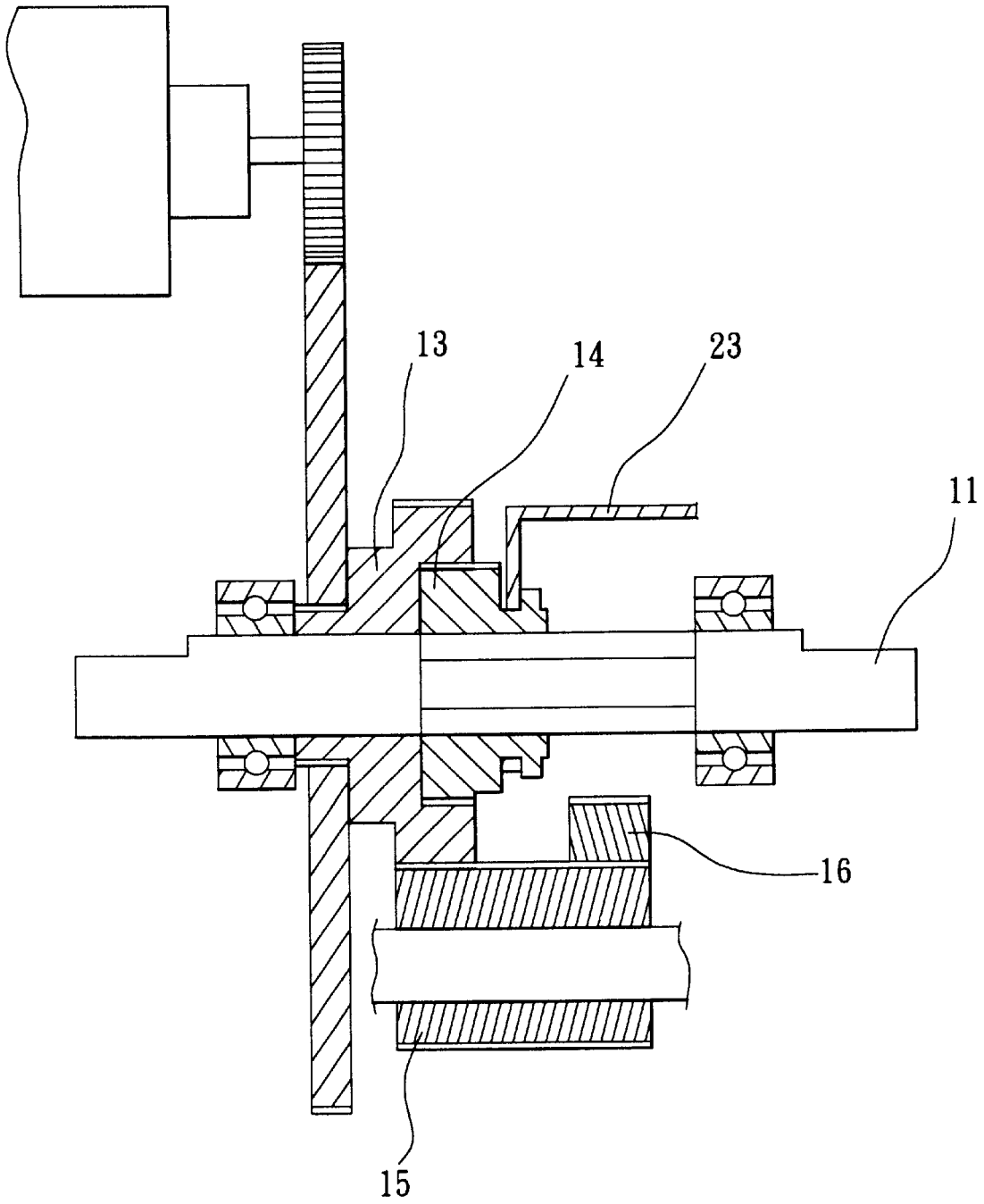
FIG. 4 is a sectional view showing the movable gear moved to the first position according to the present invention.

Referring to FIGS. from 2 through 4, when in use, the user can operate the remote controller to control the server 2, thereby causing the rocker arm 21 to be turned forwards or backwards. When turning the rocker arm 21 forwards, the first link 12 is moved forwards, causing the second link 23 to move the movable gear 14 from the first position to the second position (see FIGS. 2 and 3). On the contrary, when turning the rocker arm 21 backwards, the first link 12 is moved backwards, thereby causing the second link 23 to move the movable gear 14 from the second position to the first position (see FIG. 4). When starting the engine 3 to rotate the driving gear 31 after the movable gear 14 had been moved to the second position as shown in FIGS. 2 and 3, the driven gear 12 is driven by the driving gear 31 to rotate the transmission wheel 13 clockwise, thereby causing the first idle 15 to be rotated counter-clockwise, and at the same time the second idle gear 16 is driven by the first idle gear 15 to rotate clockwise, causing the movable gear 14 to be rotated counter-clockwise, and therefore the transmission shaft 11 is rotated counter-clockwise to move the toy car backwards. On the contrary, when moving the movable gear 14 from the second position to the first position as shown in FIG. 1, the movable gear 14 is meshed with the internal gear 132 of the transmission wheel 13 and rotated with the transmission wheel 13 clockwise, thereby causing the transmission shaft 11 to be rotated with the movable gear 14 clockwise, and therefore the toy car is moved forwards, and at the same time the first idle gear 15 and the second idle gear 16 run idle.

While only one embodiment of the present invention has been shown and described, it will be understood that various modifications and changes could be made thereunto without departing from the spirit and scope of the invention disclosed.

What the invention claimed is:

1. A forward/backward steering control mechanism installed in a toy car and coupled to a power drive and controlled by a remote controller to move the toy car forwards/backwards, comprising:

a transmission shaft coupled between front wheel system and rear wheel system of the toy car, said transmission shaft comprising a polygonal segment;

a transmission wheel revolvably mounted on said transmission shaft, said transmission wheel comprising an external gear coupled to the power drive of the toy car, and an internal gear;

a first idle gear meshed with the external gear of said transmission wheel;

a second idle gear meshed with said first idle gear;

a movable gear mounted on the polygonal segment of said transmission shaft and moved on the polygonal segment of said transmission shaft between a first position where said movable gear is meshed with the internal gear of said transmission wheel for enabling said transmission shaft to be rotated with said transmission wheel clockwise to move the toy car forwards, and a second position where said movable gear is disengaged from the internal gear of said transmission wheel and meshed with said second idle gear to rotate said transmission shaft counter-clockwise in moving the toy car backwards during rotary motion of said transmission wheel; and a server controlled by the remote controller to move said movable gear between said first position and said second position, said server comprising link means coupled to said movable gear.

* * * * *